United States Patent [19]

Byers

[11] Patent Number: 4,510,824

[45] Date of Patent: Apr. 16, 1985

[54] SHARPENER DEVICE WITH GUIDE MEANS

[76] Inventor: John E. Byers, P.O. Box 556, Whitefish, Mont. 59937

[21] Appl. No.: 462,743

[22] Filed: Feb. 28, 1983

[51] Int. Cl.[3] ..... B21K 5/12

[52] U.S. Cl. ..... 76/86; 51/214

[58] Field of Search ..... 76/82, 82.2, 86, 88, 76/82.1; 51/214

[56] References Cited

U.S. PATENT DOCUMENTS

| | | | |
|---|---|---|---|
| 468,472 | 2/1892 | Chailly | 76/86 |
| 950,530 | 3/1910 | Dow | 76/86 |
| 1,032,910 | 7/1912 | Jackson | 76/86 |
| 3,293,949 | 12/1966 | Lindsay | 76/82.2 |

FOREIGN PATENT DOCUMENTS

| | | | |
|---|---|---|---|
| 408887 | 1/1968 | Australia | 76/88 |
| 652581 | 4/1951 | United Kingdom | 76/86 |

*Primary Examiner*—Roscoe V. Parker

*Attorney, Agent, or Firm*—Cole, Jensen & Puntigam

[57] ABSTRACT

A surface mounted sharpening tool having a generally rectangular body which may be formed of one or two sections and which body has blade cavity structure with sharpening blades forming a V-shaped sharpening notch. The body includes a pair of generally parallel guide ridges extending outwardly from the body such that a guide slot is defined between the two ridges or in which the guide slot may be recessed into the body. The guide slot through which the tool to be sharpened is guided is set at a predetermined angle from a right angle to the flat surface of the blade in order to obtain the most favorable sharpening action.

8 Claims, 9 Drawing Figures

SHARPENER DEVICE WITH GUIDE MEANS

BACKGROUND OF THE INVENTION

The invention relates generally to the field of hand tools and more particularly to a sharpening device which may be attached to a surface for sharpening knives or other double-edged cutting blades.

As most people are aware, there are great variety of sharpening devices available for home, business, commercial and industrial uses, ranging from complicated and expensive grinders to simple home-type knife sharpeners. Many sharpening operations can be handled best with manually applied tools. Among the hand tool variety of sharpening devices are scrapers, files and different types of intersecting circular elements or intersecting straight blade elements which define a nip or V-shaped cavity into which the tool blade is to be inserted in order to be sharpened. The blade is pulled through the sharpening device or the sharpener is drawn along the blade edge in order to effect the sharpening action.

Whether the sharpening device is hand held or whether it is mounted, such tools do become dull and must either be sharpened or discarded after they have become dull.

The only known prior art reference which is of interest but not relevant is U.S. Pat. No. 3,149,506.

SUMMARY OF THE INVENTION

Sharpening device having a generally rectangular body for mounting on a work bench or other surface in which the body is comprised of a main and a cover section each of which accommodates a sharpening blade. The blades themselves are generally flat members which have sharpening edges and flat faces or surfaces and which are disposed to form a V-shaped sharpening notch relative to which the blade to be sharpened is moved. Blade cavities in the main and cover sections of the body are slightly less deep then the blades are thick so that when the two body sections are tightly bolted together the blades are brought into tight frictional engagement with each other and the cavity walls as a result of which they are firmly held in position. Alternatively, the body may be a single piece unit in which the blade cavity is formed and into which the blades are pressed. A pair of protruding ridges are located on the surface of the body to define a generally guide groove or slot which is disposed at about a 5 degrees angle to a line which is at a right angle to the flat surfaces of the blades so that the blade being drawn through the sharpener is guided across the sharpening edges at a desired angle.

Accordingly, it is among the features and advantages of the invention to provide a sharpening device which incorporates replaceable blade means. The invention is inexpensive, simple in design and uniquely effective in sharpening tools such as knives and other double edged cutting blades. The sharpener blades are easily removed for resharpening or for replacement. The unique feature of guiding the blade to be sharpened through the sharpening notch at an angle insures that even and proper sharpening is performed on both sides of the blade being sharpened.

DESCRIPTION OF PREFERRED EMBODIMENT

Figure 1:
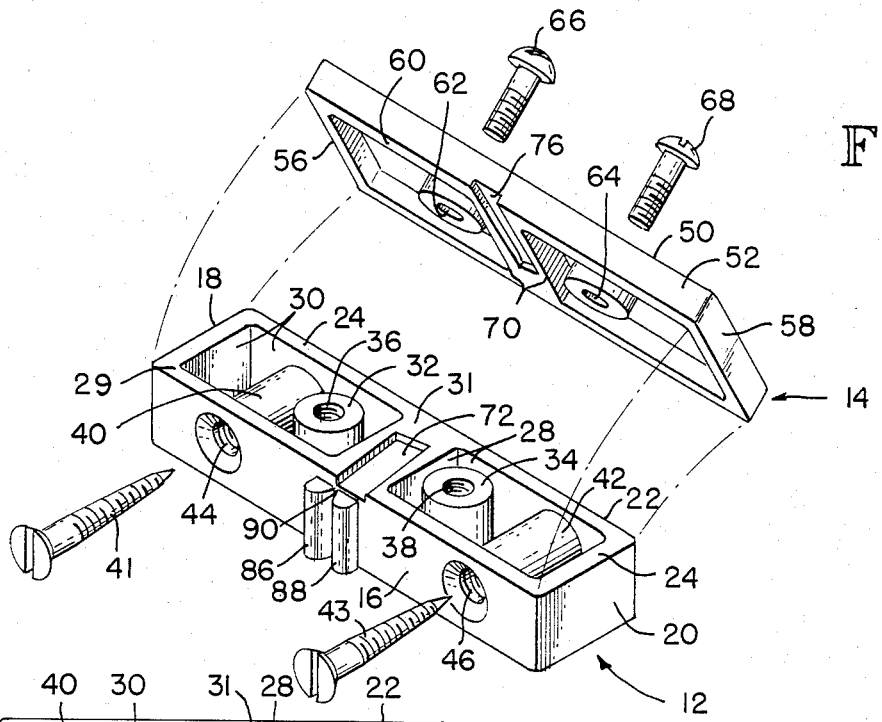
FIG. 1 is a view showing the main and cover sections of the body separated from each other to illustrate details of the invention.
Figure 2:
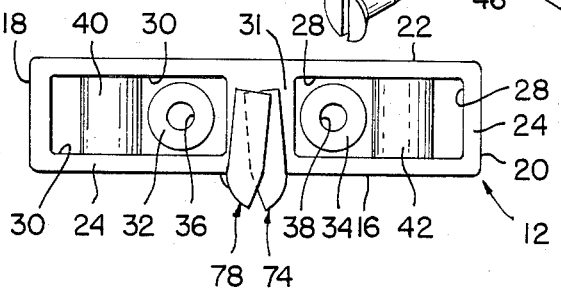
FIG. 2 is an interior view of the main portion of the body to further illustrate details of construction.
Figure 3:
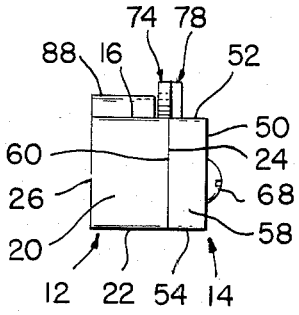
FIG. 3 is an end view of the sharpening device showing additional details.
Figure 4:
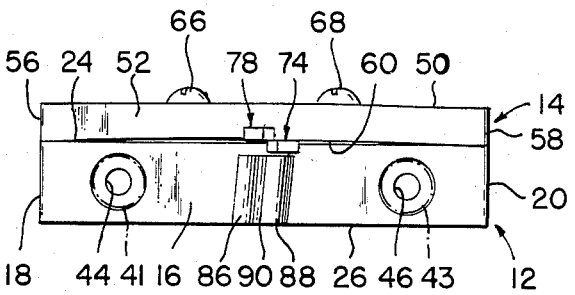
FIG. 4 is a top plan view showing further details.
Figure 5:
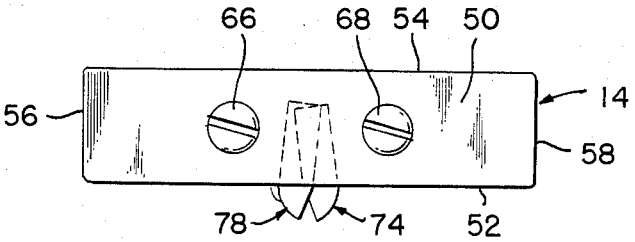
FIG. 5 is a view showing additional details of the assembled device.

Referring now to the drawings, it will be seen that the invention, generally designated by the number 10, has a body preferably of plastic which includes a main section 12 and a detachable cover section 14. The main section 12 is approximately three times the thickness of the cover section 14. Main section 12 includes upper surface 16, end surfaces 18 and 20, bottom surface 22, back surface 24, and front surface 26. As can be seen, the interior is hollow except for a central part thereof. Interior wall surfaces 28 define a chamber at one end of the main section 12 and interior wall surfaces 30 define a second chamber. Disposed between the chambers is thick center wall portion having surface 31 which is flush with the back surface 24 and which defines the top of the wall against which the upper section 14 is secured when the two sections are put together.

Within the hollowed out areas or chambers defined by interior walls 28 and 30 are generally round reinforcement sections 32 and 34 which receive threaded metal inserts 36 and 38 which are on a plane generally flush with surfaces 24 and 31. Also extending through the chambers are reinforcement sections 40 and 42 which extend from top surface 16 to bottom surface 22 and which have openings 44 and 46 extending therethrough to receive screws 41 and 43 for securing the device 10 to a surface. The center wall section is located between the reinforcement sections 32 and 34.

The removable cover body section 14 is approximately $\frac{1}{3}$ of the thickness of the main body section 12. It includes outer surface 50, upper edge surface 52, bottom edge surface 54, and end surfaces 56 and 58 and interior surface 60. Cover section 12 also includes screw passage openings 62 and 64 through thick reinforcement areas which are aligned with the threaded inserts 36 and 38 of the main of the body to receive screws 66 and 68. Between the openings 62 and 64 is a central wall 70 which aligns with the central wall portion 30 of body section 12.

Figure 6:
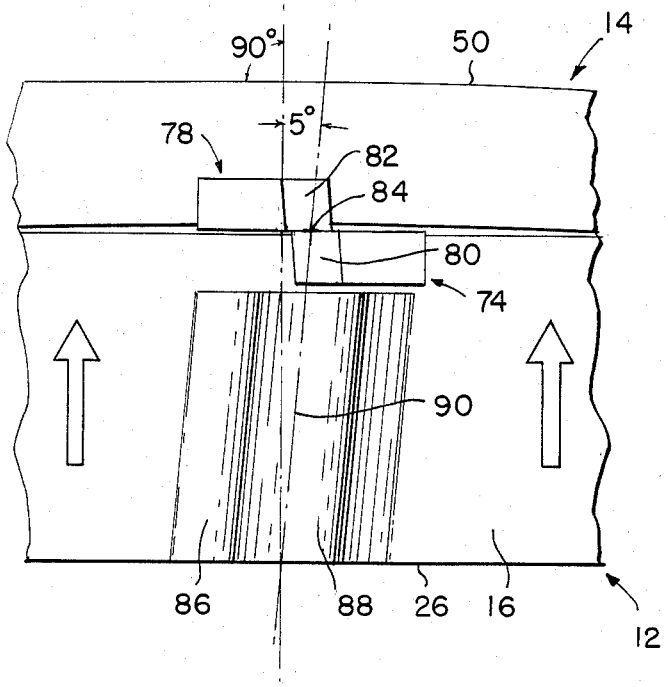
FIG. 6 is a partial top plan view enlarged to show details of relationships of parts of the device.
Figure 7:
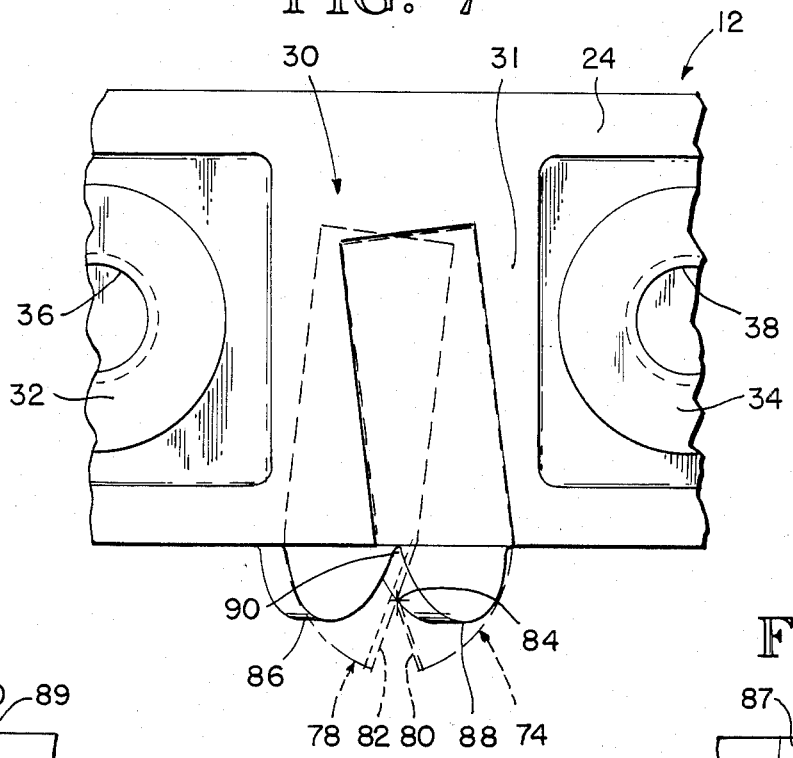
FIG. 7 is a partial view of the relationship of the blades to the guide groove.

FIGS. 6 and 7 show important details of the device. The central wall portion 30 of the main body section includes a blade cavity 72 which as can be seen is generally rectangular and opens onto surface 16. The blade cavity 72 (see FIG. 1) is disposed at a predetermined angle to receive blade 74 so that the sharpening edges of the blades intersect at the desired angle. In like manner, a cavity 76 (see FIG. 1) is disposed in the cover central wall portion 70 and receives blade 78. FIG. 7 shows the relationship of the blades to each other with blades 74 and 78 being shown in dotted lines to facilitate understanding of the relationship of the parts.

While it is not a part of the invention, it will be appreciated that the cutting surfaces 80 and 82 of the blades are formed at approximately a 5° angle. The two surfaces angle from the outside edges outwardly, to the two edges which abut, and form an intersection. The two cutting edges which abut form an intersect point 84 the purpose of which will be described hereinafter.

Located on the top surface 16 of main body portion 12 are two generally parallel upstanding ridge members 86 and 88 which define a guide slot or groove 90 which is generally V-shaped. The ridges 86 and 88 are formed at an angle approximately 5° off a line which is 90° to the plane of the two abutting and intersecting faces or surfaces of blades 74 and 78. The guide slot or groove 90 is generally on a line with the intersect point 84 as is best seen in FIGS. 6 and 7. It will be appreciated that the intersect point 84 of the blades is slightly outwardly of the bottom of guide groove or slot 90 generally in a plane which is perpendicular to the slot 90. When a blade to be sharpened is guided through the sharpener device, it will move against and past the sharpening edges of surfaces 80 and 82 at the desired angle of entry. The angle of entry allows the sharpener blades which are tungsten carbide type blades to make an even cut on both sides of the blade to be sharpened. Again, the relief angle on the cutting surfaces preferably is about 3°–5° though it might be slightly more or less if desired. Also, the angle at which the guide slot 90 is disposed may be slightly more or less than the preferred 5° to a line which is normal or at 90° to the flat cutting blade faces.

It is to be understood that the body may be a single piece unit in which case the cavity for the coacting blade surfaces would be cast, molded or otherwise formed to accommodate the sharpening blade means as for instance by a pressed fit into such cavity. The shape of the sharpener body may vary. However, the combination of features for guiding the blade at the desired angle through the V-shaped sharpening notch is important. The guide slot as shown is defined by parallel raised ridges. The guide slot may also be formed as a recess in the body in which case the sharpening blade means would be inserted further in the body to define the same relationship of sharpening blades and guide slot with the intersect point 84.

Figure 8:
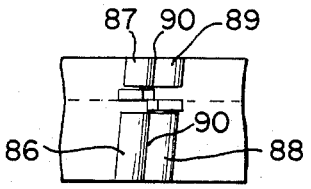
FIG. 8 is a partial view showing the body with guide grooves on both sides of the blades.
Figure 9:
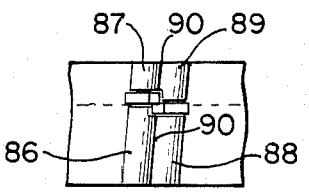
FIG. 9 is a partial view showing guide grooves on both sides of the blades but with the guide slot conforming with the blade arrangement.

While it is preferred that the guide slot extend at its angle from both sides of the blades it will be understood that the guide feature may be on one side only of the sharpening blades as is seen in FIGS. 1, 2, 3 and 6. FIGS. 8 and 9 show partial single piece bodies with the ridges or recessed slots, as the case may be, formed in a straight line across the ends as in FIG. 8 or offset adjacent the blades as in FIG. 9. The guide slot may be of only a short length if desired and is a short guide slot is appropriate to the body size and configuration.

What is claimed is:

1. A sharpening device, comprising:

(a) a body which includes flat, removable sharpening blade means which are supported in and extend out of said body and which define a generally V-shaped sharpening notch for blades to be sharpened, (b) guide slot means on said body aligned with and for guiding said blades to be sharpened through said V-shaped sharpening notch, said guide slot means being disposed at a predetermined angle to a line which is normal to the sharpening blade means and said guide slot means being in the same general perpendicular plane as the bottom of said V-shaped sharpening notch, said bottom of said V-shaped sharpening notch being spaced above said guide slot means a slight predetermined distance.

2. The sharpening device according to claim 1 and in which said body is a single piece plastic, mold-formed unit in which a cavity for said sharpening blade means is formed and in which said sharpening blade means are securely held within said cavity.

3. The sharpening device according to claim 2 and in which said guide slot means is also generally V-shaped and wherein the bottom of said guide slot means is generally coincident with said generally vertical plane.

4. The sharpening device according to claim 3 and in which said predetermined angle is about 5°.

5. The sharpening device according to claim 4 and wherein said guide slot means is located on both sides of and aligned with said sharpening blade means at said predetermined angle.

6. The sharpening device according to claim 1 and wherein said body is formed of two separable pieces and wherein at least one of said two pieces includes said guide slot means.

7. The sharpening device according to claim 6 and wherein said guide slot means is formed of two raised, parallel ridge members.

8. The sharpening device according to claim 1 and wherein said guide slot means is formed as a recess in said body.

* * * * *